United States Patent [19]

Nobile

[11] Patent Number: 4,882,989

[45] Date of Patent: Nov. 28, 1989

[54] MAILING MACHINE INCLUDING IMPROVED SHEET ALIGNING MEANS

[75] Inventor: John R. Nobile, Fairfield, Conn.

[73] Assignee: Pitney Bowes Inc., Stamford, Conn.

[21] Appl. No.: 307,793

[22] Filed: Feb. 8, 1989

[51] Int. Cl.[4] ..... B41F 13/24

[52] U.S. Cl. ..... 101/235; 271/245; 271/246; 271/265; 271/236

[58] Field of Search ..... 101/232, 233, 234, 235, 101/236, 237, 238, 239; 271/245, 246, 265, 236

[56] References Cited

U.S. PATENT DOCUMENTS

| | | | |
|---|---|---|---|
| 1,596,967 | 8/1926 | Hansen | 101/235 |
| 1,892,136 | 12/1932 | Clark | 101/236 |
| 2,130,897 | 9/1938 | Ogden | 101/235 |
| 2,693,754 | 11/1954 | Persson | 101/235 |
| 2,756,673 | 7/1956 | George | 101/233 |
| 2,871,781 | 2/1959 | Schrempp | 101/235 |
| 2,934,009 | 4/1960 | Bach et al. | 101/235 |
| 3,738,643 | 6/1973 | Bell et al. | 271/246 |
| 4,645,195 | 2/1987 | Scranton | 271/245 |
| 4,831,273 | 5/1989 | Ross et al. | 101/233 |

OTHER PUBLICATIONS

"Document Gate and Feed Control Mechanism", IBM Tech. Discl. Bulletin, vol. 11, No. 2, Jul. 1968, p. 186.

*Primary Examiner*—E. H. Eickholt

*Attorney, Agent, or Firm*—Donald P. Walker; Melvin J. Scolnick; David E. Pitchenik

[57] ABSTRACT

In a mailing machine including a postage meter, wherein the postge meter includes rotary structure for printing indicia on a sheet fed to the machine, wherein the machine includes apparatus for driving the printing structure, wherein the machine includes apparatus for feeding a sheet fed thereto downstream in a path of travel through the machine, wherein the sheet feeding apparatus includes an impression roller rotatably mounted beneath the rotary printing structure, and wherein the impression roller has an inner end and an outer end, an improvement comprising: apparatus for aligning a sheet fed to the machine with the path of travel, the aligning apparatus including a registration fence aligned with the path of travel, the aligning apparatus including an elongate stop lever and a shaft on which the lever is pivotally mounted outboard of the outer end of the impression roller, the stop lever extending into the path of travel for pivoting a sheet fed thereto toward the registration fence, the aligning apparatus including a cam rotatable with the printing structure, the aligning apparatus including a cam follower secured to the shaft and disposed in engagement with the cam; and apparatus for starting operation of the driving apparatus in response to the sheet being fed to the machine, the driving apparatus rotating the cam when the driving apparatus is started, the stop lever located relative to the starting apparatus for pivoting a sheet fed thereto before the driving apparatus is started, and the cam dimensioned for rotating the cam shaft for lowering the stop lever out of the path of travel after the driving apparatus is started.

12 Claims, 5 Drawing Sheets

MAILING MACHINE INCLUDING IMPROVED SHEET ALIGNING MEANS

BACKGROUND OF THE INVENTION

The present invention is generally concerned with mailing machines, including means for aligning sheets fed thereto, and more particularly with an improved means for aligning sheets fed to a mailing machine with a path of travel in which the sheets are fed therethrough.

As shown in U.S. Pat. No. 2,934,009, issued Apr. 26, 1962, to Bach, et al. and assigned to the assignee of the present invention, there is described a mailing machine which includes a postage meter and a base on which the postage meter is removably mounted. The postage meter includes a rotary printing drum, for printing postage on a sheet, and a drive gear for the drum. And, the base includes a drive mechanism having an output gear which is disposed in meshing engagement with the drum drive gear when the postage meter is mounted on the base. The drive mechanism includes a single revolution clutch, having a helical spring, for rotating the output gear and thus the drum drive gear, which, in turn, rotates the drum into engagement with a sheet fed to the drum. Each revolution of the clutch, and thus of the drum, is initiated by a sheet engaging a trip lever to release the helical spring for causing the drum to rotate into engagement with the sheet and print a postage value thereon. Moreover, the mailing machine includes structure for feeding the sheet downstream beneath the drum as the drum returns to its home position. Thus the drive mechanism intermittently operates the rotary printing drum in response to a sheet fed thereto engaging the trip lever.

As shown in U.S. Pat. No. 2,871,781 issued Feb. 3, 1959 to Schremfp and assigned to the assignee of the present invention, the mailing machine additionally includes sheet feeding apparatus mounted in the base for feeding sheets downstream in the path of travel. The sheet feeding apparatus includes an impression roller resiliently mounted beneath the postage meter drum to accommodate urging letters of different thickness into printing engagement with the rotating drum.

Although the single revolution clutch structure has been replaced by other intermittently operable drive systems in low volume applications, the sheet feeding and trip structures of the prior art have been retained although experience has shown that the presently available mechanical structures often malfunction and are thus relatively expensive to maintain.

Apart from the above considerations, it has been found that whether or not the sheet feeding and trip structures of the prior art malfunction, customers often misfeed sheets to the machine, most usually by feeding sheets aslant to the edge registration fence provided for properly aligning the sheets with the path of travel in which the sheets are fed to through the machine.

Accordingly, an object of the invention is to replace the trip structure of the prior art with a simplified, easily maintainable and highly reliable trip system;

Another object is to provide improved sheet feeding means; and

Another object is to provide improved edge registration structure.

SUMMARY OF THE INVENTION

In a mailing machine including a postage meter, wherein the postage meter includes rotary means for printing indicia on a sheet fed to the machine, wherein the machine includes means for driving the printing means, wherein the machine includes means for feeding a sheet fed thereto downstream in a path of travel through the machine, wherein the sheet feeding means includes an impression roller rotatably mounted beneath the rotary printing means, and wherein the impression roller has a inner end and an outer end, an improvement comprising: means for aligning a sheet fed to the machine with the path of travel, the aligning means including a registration fence aligned with the path of travel, the aligning means including an elongate stop lever and a shaft on which the lever is pivotally mounted outboard of the outer end of the impression roller, the stop lever extending into the path of travel for pivoting a sheet fed thereto toward the registration fence, the aligning means including a cam rotatable with the printing means, the aligning means including a cam follower secured to the shaft and disposed in engagement with the cam; and means for starting operation of the driving means in response to a sheet being fed to the machine, the driving means rotating the cam when the driving means is started, the stop lever located relative to the starting means for pivoting a sheet fed thereto before the driving means is started, and the cam dimensioned for rotating the cam shaft for lowering the stop lever out of the path of travel after the driving means is started.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
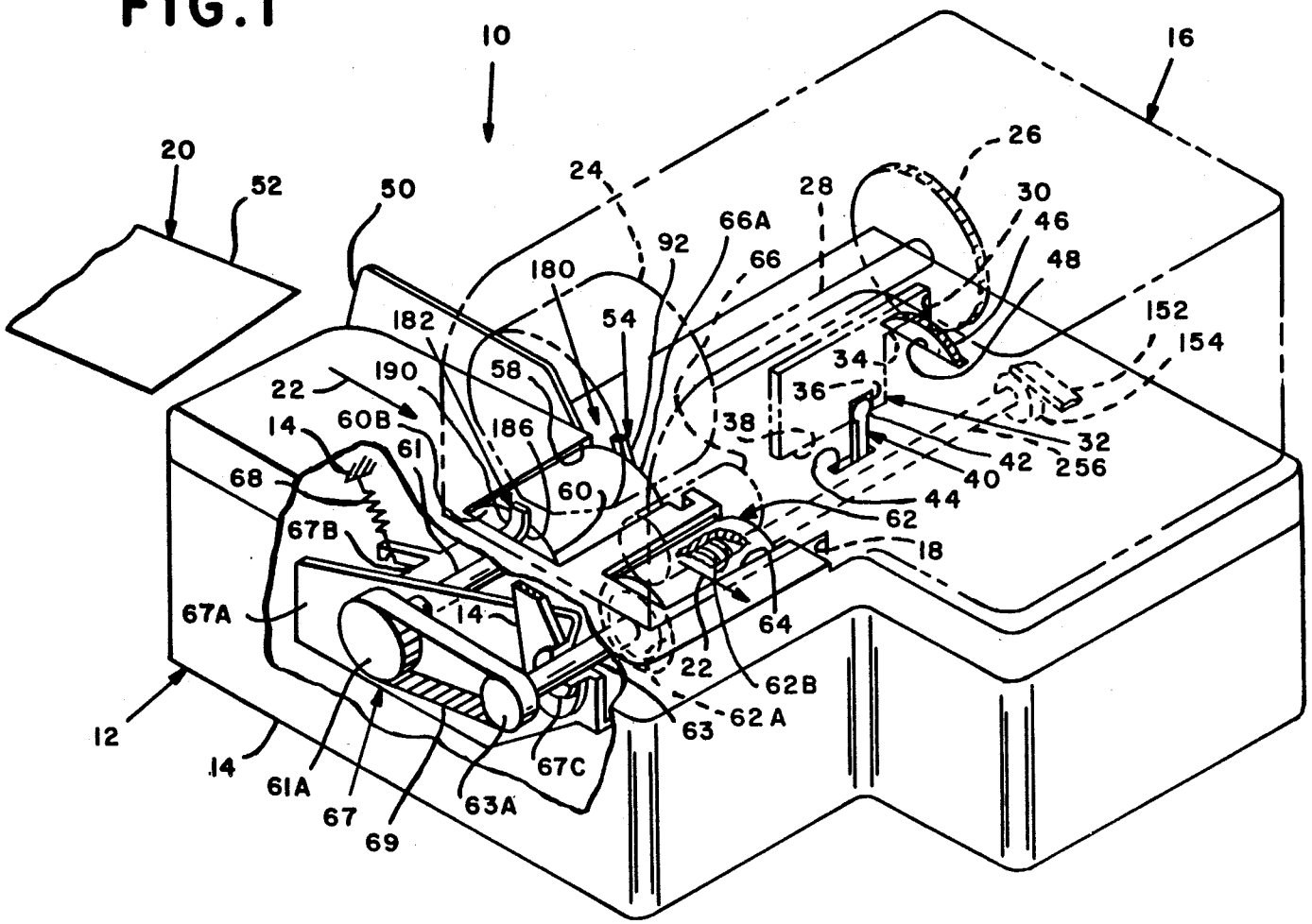
FIG. 1 is a partially phantom, perspective, view of a prior art mailing machine, including a postage meter removably mounted on a base, showing apparatus according to the invention including means for feeding a sheet through the machine.

As shown in FIG. 1, the apparatus in which the invention may be incorporated generally includes a mailing machine 10 which includes a base 12, having a housing 14, and a postage meter 16 which is removably mounted on the base 12. When mounted on the base 12, the postage meter 16 forms therewith a slot 18 through which sheets 20, including mailpieces such as letters, envelopes, cards or other sheet-like materials, may be fed in a downstream path of travel 22.

The postage meter 16 (FIG. 1) includes rotary printing structure including a postage printing drum 24 and a drive gear 26 therefor. The drum 24 and drive gear 26 are spaced apart from one another and mounted on a common drum drive shaft 28. The drum 24 is conventionally constructed and arranged for feeding the respective sheets 20 in the path of travel 22, which extends beneath the drum 24, and for printing postage data, registration data or other selected indicia on the upwardly disposed surface of each sheet 20. The drum drive gear 26 has a key slot 30 formed therein, which is located vertically beneath the drum drive shaft 28 when the postage meter drum 24 and drive gear 26 are located in their respective home positions. The postage meter 16 additionally includes a shutter bar 32, having an elongate key portion 34 which is transversely dimensioned to fit into the drive gear's key slot 30. The shutter bar 32 is conventionally reciprocably mounted within the meter 16 for movement toward and away from the drum drive gear 26, to permit moving the shutter bar's key portion 34 into and out of the key slot 30, under the control of the mailing machines base 10, when the drum drive gear 26 is located in its home position. To that end, the shutter bar 32 has a channel 36 formed thereinto from its lower surface 38, and, the mailing machine's base 12 includes a movable lever arm 40, having an arcuately-shaped upper end 42, which extends upwardly through an aperture 44 formed in the housing 14. When the meter 16 is mounted on the base 10, the lever arm's upper end 42 fits into the channel 36 in bearing engagement with the shutter bar 32 for reciprocally moving the bar 32, to and between one position, wherein shutter bar's key portion 34 is located in the drum drive gear's key slot 30, for preventing rotation of the drum drive gear; 26, and another position wherein the key portion 34 is located out of the key slot 30, for permitting rotation of the drum drive gear 26. And, for driving the drum gear 26, the base 12 includes a drive system output gear 46 which extends upwardly through another housing aperture 48 and into meshing engagement with the drum gear 26.

The base 12 (FIG. 1) additionally includes a registration fence 50, aligned with the path of travel 22, against which an edge 52 of a given sheet 20 may be urged when fed to the mailing machine 10. Further, the base 12 includes drive system trip structure for sensing sheets 20 fed to the machine 10, including a trip lever 54 which extends upwardly through another housing aperture 58 and into the path of travel 22 of each sheet 20 fed to the mailing machine 10. Moreover, the base 12 includes a conventional input feed roller 60, known in the art as an impression roller. The impression roller 60, which has an inner end 60A and an outer end 60B, respectively facing inwardly and outwardly of the machine 10, is suitably secured to or integrally formed with a driven shaft 61. And the shaft 61 is resiliently connected to the housing 14, as hereinafter set forth in greater detail, for causing the roller 60 to extend upwardly through the housing aperture 58 and into the path of travel 22 for urging each sheet 20 into printing engagement with the drum 24 and cooperating therewith for feeding the sheets 20 through the machine 10.

For feeding sheets 20 (FIG. 1) from the mailing machine 10, the base 12 includes a conventional output feed roller 62, known in the art as an ejection roller. The roller 62 includes a cylindrically-shaped rim 62A which is suitably rotatably connected to a hubbed shaft 63 by means of a coil spring 62B. And the shaft 63 is rotatably connected to the housing 14, as hereinafter set forth in greater detail, for causing the roller 62 to extend upwardly through a further housing aperture 64 and into the path of travel 22. Thus the rim 62A is driven by the shaft 63 via the coil spring 62B. Moreover, the postage meter 16 includes a suitable idler roller 66 which is conventionally yieldably mounted, to accommodate mixed thickness batches of sheets 20, with its axis disposed parallel with the axis of the ejection roller 62, when the meter 16 is mounted on the base 14. As thus mounted, the idler roller 66 extends downwardly into the path of travel 22. Preferably, the idler roller 66 is also conventionally movably mounted for adjusting vertical spacing thereof from the ejection roller 62, to accommodate feeding a given batch of relatively thick sheets 20, such as a batch of envelopes which are each stuffed with a letter and inserts.

According to the invention, the base 12 (FIG. 1), and thus the mailing machine 10, includes an elongate impression roller carriage 67 which includes a pair of parallel-spaced side walls 67A, one of which is shown, and a lower wall 67B which extends between and is suitably secured to or integrally formed with the side walls 67A. The carriage 67 generally horizontally extends from the ejection roller shaft 63, and beneath and in supporting relationship with the impression roller shaft 61. More particularly, one end of each of the carriage side walls 67A is preferably pivotably attached to the housing 14 so as to define parallel-spaced arcuately-shaped bearing surfaces 67C within which the ejection roller shaft 63 is rotatably mounted. Moreover, the side walls 67A are conventionally constructed and arranges for rotatably supporting the opposed ends of the impression roller shaft 61. And, the carriage lower wall 67B is preferably connected to the housing 14 by means of a depending spring 68. Further, the base 12 includes a driven gear 61A which is suitably fixedly connected to or integrally formed with the impression roller shaft 61. Thus, the impression roller shaft 61 and drive gear 61A are both conventionally rotatably connected to the carriage 67. In addition, the base 12 includes a driven gear 63A which is suitably fixedly connected to or integrally formed with the ejection roller shaft 63. And, the base 12 includes an endless gear belt 69 which is looped about the gears 61A and 63A for transmitting rotational movement of the gear 61A to the gear 63A, whereby the ejection roller shaft 63 and the impression roller 60 are driven in timed relationship with one another. Moreover, the gears 61A and 63A, and the impression roller 60 and ejection roller 62, are relatively dimensioned for ensuring that the peripheral velocity of the ejection roller 62 is greater than the peripheral velocity of the impression roller 60, when neither of the respective rollers 60 and 62 are in engagement with a sheet 20 fed thereto. As thus constructed and arranged, when the impression roller 60 is urged downwardly, the impression roller drive shaft 61 and drive gear 61A therefor are urged downwardly as the supporting carriage 67 pivots downwardly about the ejection roller shaft 63, against the force exerted on the carriage 67 by the spring 68, to provide a variable gap between the drum 24 and impression roller 60, to accommodate mixed thickness sheets 20. And the spring 68 resiliently urges the carriage 70, and thus the impression roller 60, upwardly against any downwardly directed force exerted on the impression roller 60, by a given sheet 20 fed beneath the postage meter drum 24, for urging mixed thickness sheets 20 into printing engagement with the drum 24.

In addition, according to the invention, the base 12 (FIG. 1), and thus the mailing machine 10, includes a drive system 70 (FIG. 2) for driving the shutter bar lever arm 40, and for driving the drive system output gear 46 and thus the postage meter drum 24 (FIG. 1), the ejection roller shaft 63 and impression roller 60 preferably in timed relationship with one another. The drive system 70 (FIG. 2) is conventionally supported by the housing 14 and generally includes a control mechanism 74, relevant portions of which are shown in greater detail, and drive system operating apparatus 76. The operating apparatus 76 generally includes trip level structure 80 and, in addition, a plurality of components, including the trip switch 72, a motor switch 82, a d.c. motor drive system 84, and a control circuit 86 to which the components 72, 82 and 84 are electrically connected.

The control mechanism 74 (FIG. 2) preferably includes any conventional structure for normally holding the shutter bar lever arm 40, against the force of suitable resilient structure in which energy is stored for actuating the lever arm 40, to hold the shutter bar's key portion 34 in the drum drive gear's key slot 30, thereby holding the shutter bar 32 in locking engagement with the drum drive gear 26, for preventing rotation of the drum drive gear 26 and thus the drum 24. The resilient structure actuates the lever arm 40, in response to actuation of the trip switch 70 by a sheet 20 fed to the machine 10, for urging the shutter bar lever arm 40 to move the shutter bar 32 out of locking engagement with the drum drive gear 26, thereby permitting rotation of the drum 24, and into engagement with the motor switch 82 for actuating the motor switch 82 to start operation of the drive mechanism 70. And, the drive mechanism 74 preferably includes additional conventional structure for restoring the energy in the resilient structure during a single revolution of the drum drive gear 26 and then causing the shutter bar lever arm 40 to actuate the motor switch 82, to stop operation of the drive mechanism 74 and to move the shutter bar 30 into locking engagement with the drum drive gear 24. In addition, the control mechanism includes a generally annularly-shaped rotary cam 88, which is suitable secured to or integrally formed with a drive shaft 89. The drive shaft 89 is conventionally connected to the housing 14, to permit rotation of the cam 88 in a generally vertically-extending plane. As viewed from the end of the shaft 89 which extends inwardly of the housing 14, the cam 88 has an outer, peripherally-extending, D-shaped cam surface 88A.

The trip lever structure 84 (FIG. 2) includes the trip lever 54, which is an elongate member conventionally pivotably mounted for rotation, in a generally vertically-extending plane in the path of travel 22, on a pivot shaft 90 which is secured to or integrally formed with the housing 14. The trip lever 54 has an upper leg 92, which extends upwardly from the shaft 90 and into the path of travel 22 (FIG. 1), inboard of the inner end 60A of the impression roller 60 (FIG. 2), and a depending leg 94, which extends downwardly from the pivot shaft 90, acts as a lever arm and includes a slot 96 formed therein. The trip lever 54 preferably includes a shoulder 98, extending from the upper leg 92 and having an arcuately-extending upper edge 100 which curvedly extends downwardly and towards respective sheets 20 fed thereto for upwardly supporting and guiding such sheets 20 into the path of travel 22 when the trip lever 54 is engaged and moved by such sheets 20. In addition, the upper leg 92 of the trip lever 54 includes a lower, laterally-extending trip switch actuating shoulder 102, and the lower leg 94 of the trip lever 54 includes a cam follower 104 which extends transverse to the direction of the path of travel 22. The trip lever structure 80 further includes a spring 106 having one end located in the depending leg's slot 94 and the other end conventionally connected to the housing 14 above the lower end of the depending leg 94 but below the level of the axis of the trip lever pivot shaft 90. Preferably, the spring constant of the spring 106 is chosen to be small enough to permit any sheet 20 which is of sufficient weight to be fed through the machine 10 and marked with indicia, without being torn or creating a jam condition, to also be capable of pivoting the trip lever 54 against the force of the spring 106 when the sheet 20 is normally fed to the machine 10.

The trip switch 72 (FIG. 2) is preferably a single pole double throw switch having two modes of operation. The switch 72 is conventionally connected to the housing 14 for suitable location of the switch 72 relative to the trip lever's switch actuating shoulder 102, to allow the shoulder 102 to operate the switch 72 in response to movement of the trip lever 54. The switch 72 includes an operating lead 110 and two switch position leads, 110A and 110B. When the switch 86 is in one of its modes of operation, the leads 110 and 110A are electrically connected, whereas when the switch 72 is in its other mode of operation, the leads 110 and 110B are electrically connected.

The motor switch 82 (FIG. 2) is preferably a single pole double throw switch having two modes of operation. The switch 82 is conventionally connected to the housing 14 for suitable location of the switch 82 relative to the shutter bar lever arm 40 to operate the switch 82 in response to movement of the lever arm 40. The switch 82 includes an operating lead 120 and two switch position leads 120A and 120B. When the switch 82 is in one of its modes of operation, the leads 120 and 120A are electrically connected, whereas when the switch 82 in its other mode of operation, the leads 120 and 120B are electrically connected.

The d.c. motor drive system 84 (FIG. 2) preferably includes a conventional d.c. motor, 140 having an output shaft 142. The motor 84 is conventionally physically connected to the housing 14 via a gear box 144. The motor output shaft 142 is preferably connected, via a reduction gear train 146 within the gear box 144, to an output drive gear 148, which is suitably journalled to the gear box 144 for rotation. The drive system 84 additionally includes an control mechanism drive gear 150 and gear belt 152. The control mechanism drive gear 150 is suitably fixedly connected to or integrally formed with the cam drive shaft 89. Thus, the cam 88 is mounted for rotation with the drive gear 150. The gear belt 152 is endlessly looped about and disposed in meshing engagement with the drive gear 148 and cam drive gear 150. The drive system 84 further includes an ejection roller drive gear 154 and a drive shaft 156 on which the gear 154 is conventionally fixedly mounted. The drive shaft 156 is suitably rotatably connected to the housing 14 for conventionally connecting one end thereof to the ejection roller shaft 63A (FIG. 1) and disposing the ejection roller drive gear 154 (FIG. 2) in meshing engagement with the gear belt 152, between the motor output drive gear 148 and timing control mechanism drive gear 150. Moreover, the drive system 84 additionally includes the drive system output gear 46 (FIG. 2), which is suitably fixedly connected to or integrally formed with the cam drive shaft 89 for rotation therewith and extends upwardly through the housing 14 for engagement with the drum drive gear 26 (FIG. 1). Thus, the drive system output gear 46 (FIG. 1) and drum drive gear 26 are mounted for rotation with the cam 88.

Figure 7:
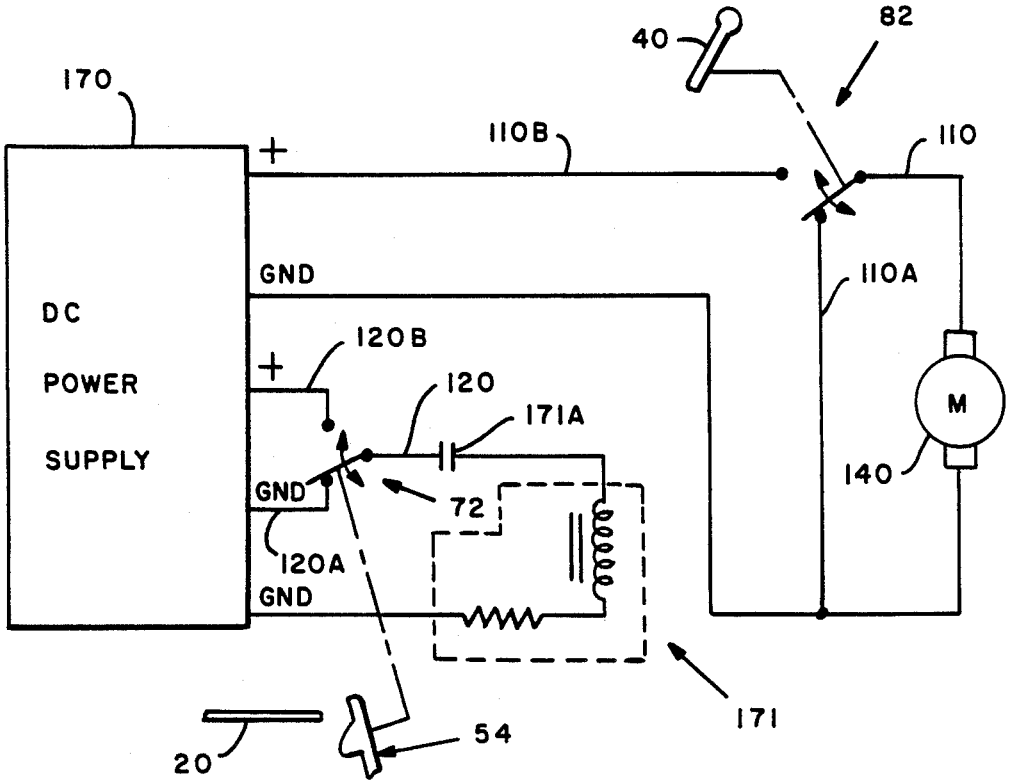
FIG. 7 is a schematic view of the control circuit of FIG. 2 the showing components thereof in their normal or at-ready mode of operation.

The control circuit 86 (FIG. 2) preferably includes a conventional D.C. power supply 170. In addition, the control circuit 86 (FIG. 7) includes suitable trip control circuitry for interconnecting the trip switch 72, a solenoid 171, a capacitor 171A and power supply 170 for energization and deenergization of the solenoid 171 and thus the driving system 70 (FIG. 2) in response to operation of the switch 72. Preferably, the trip control circuitry is conventionally constructed and arranged such that in one mode of operation the switch 170 (FIG. 7) is operated to electrically connect the switch leads 110 and 110B for energizing the solenoid 171, through the capacitor 171A, for causing the shutter bar lever arm 40 to actuate the motor switch 82. And in the other mode of operation the switch 72 is operated to electrically disconnect the switch leads 110 and 110B and electrically connect the switch leads 110 and 110A for maintaining deenergization of the solenoid 171. Further, the control circuit 86 includes suitable motor control circuitry for interconnecting the D.C. motor 140 and power supply 170 for energization and deenergization of the D.C. motor 140 in response to actuation of the switch 82 by the shutter bar lever arm 40. Preferably, the motor control circuitry is conventionally constructed and arranged such that in one mode of operation the switch 82 is operated to electrically disconnect the leads 120 and 120A, for opening a shunt circuit, such as a short circuit, across the D.C. motor 140, and to electrically connect the switch leads 120 and 120B, for energizing the D.C. motor 140 from the power supply 170. And, in the other mode of operation the switch 82 is operated to electrically disconnect the switch leads 120 and 120B, for deenergizing the D.C. motor 140, and to electrically connect the switch leads 120 and 120A, for closing the shunt circuit across the D.C. motor 140 for dynamically braking the D.C. motor 140.

A more detailed description of the control mechanism 74 and control circuit 86 may be found in U.S. patent application Ser. No. 307,803 of John Nobile et al for a Mailing Machine Including Improved Driving Means Circuit or in U.S. patent application Ser. No. 307,559 of John Nobile et al for a Mailing Machine Including Driving Means Circuit, filed concurrently herewith and assignedd to the assignee of the present invention.

According to the invention, the base 12 (FIG. 1) and thus the mailing machine 10, additionally includes sheet aligning structure 180 (FIG. 2) for aligning a sheet 20 fed to the machine 10 with the path of travel 22. The aligning structure 180 includes the registration fence 50 (FIG. 1), and an elongate stop lever 182. The stop lever 182 is conventionally mounted for rotation, in a generally vertically-extending plane in the path of travel 22, on the outboard end of a pivot shaft 184. And the pivot shaft 184 is suitably rotatably connected to the housing 14. The stop lever 182 has an upper end portion 186 which extends upwardly into the path of travel 22 of sheets 20 fed through the machine 10. As thus mounted, the stop lever's upper end portion 186 extends into the path of travel 22 (FIG. 1) outboard of the outer end 60B of the impression roller 60. The upper end portion 186 has a leading edge 190, which has an upper portion lying in a plane extending substantially vertically through the axis of the impression roller 60, and which has a lower portion which curvedly extends downwardly therefrom and towards respective sheets 20 fed thereto for upwardly supporting and guiding such sheets 20 over the impression roller 60. Further, the aligning structure 180 includes a cam follower 192 which is suitably secured to the other end of the pivot shaft 184 so as to extend therefrom and into engagement with the driving system's D-shaped cam 88, and, more particularly, with the D-shaped cam surface 88A thereof. For holding the cam follower 192 in engagement with the cam 88, the aligning structure 180 includes a depending spring 194, having one end suitably connected to the stop lever 182, preferably beneath the pivot shaft 184, and the other end, suitably connected to the housing 14. As thus constructed and arranged, the stop lever 182 is driven by the cam 88 in a path of travel determined by the geometry of cam surface 88A, cam follower 182 and stop lever 182, for timely lowering the stop lever 182 out of and beneath the path of travel 22 of sheets 20 being fed through the machine 10, and then raising the stop lever 182 into the path of travel 22 when a given sheet 20 is fed from the machine 10. For timely lowering the trip lever 44 out of and beneath the path of travel 22, the aligning structure 180 additionally includes an elongate cam 196, which is suitably secured to the pivot shaft 184 for movement therewith and is disposed in engagement with the trip levers's cam follower 104. Without departing from the spirit and scope of the invention, the trip lever structure 80 may be viewed as including the cam 196, pivot shaft 184, cam 88 and spring 194.

Figure 2:
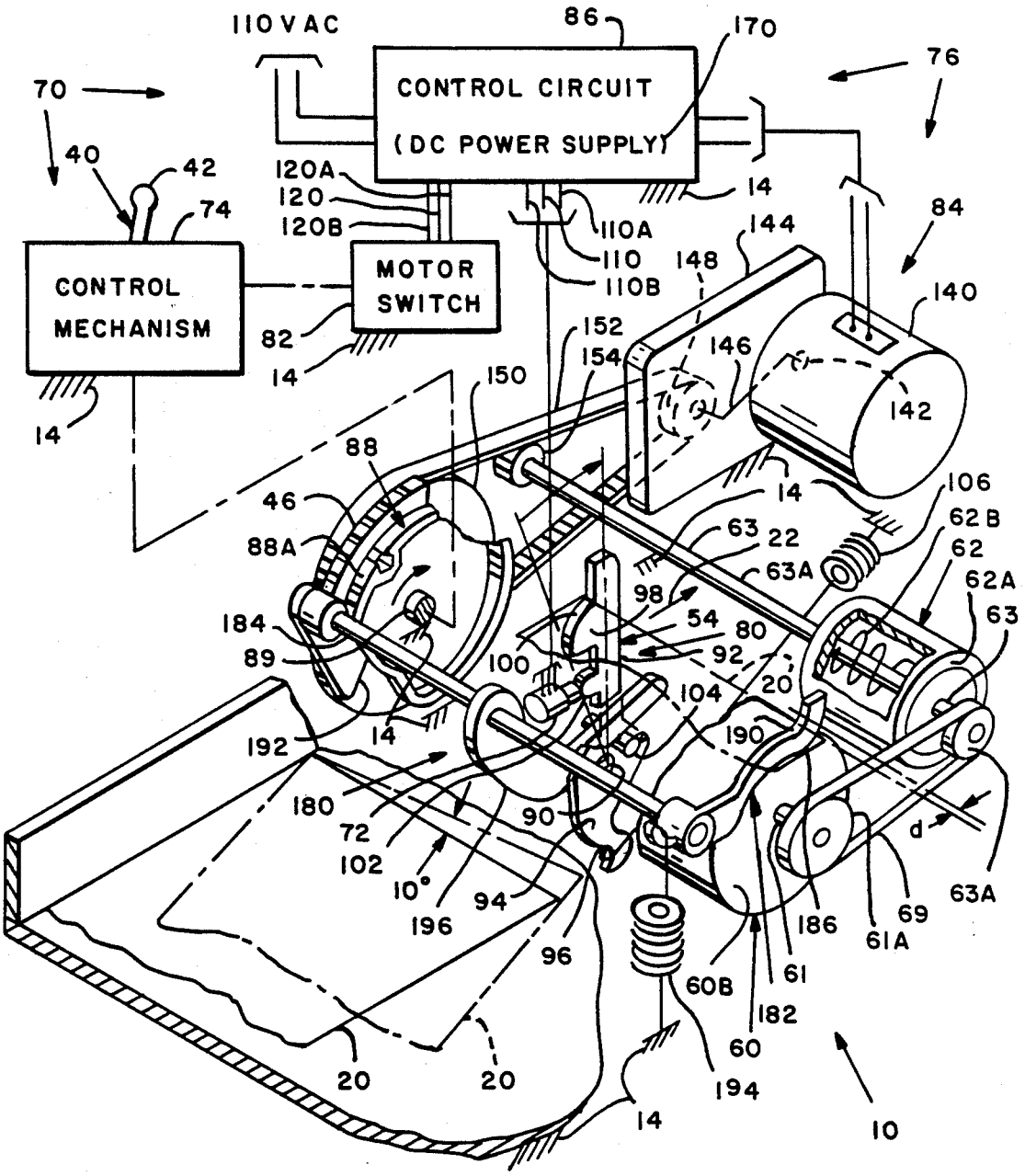
FIG. 2 is a partially schematic, perspective, view of trip means and registration means according to the invention, including the drive system therefor, and various components thereof including the control mechanism and control circuit.
Figure 3:
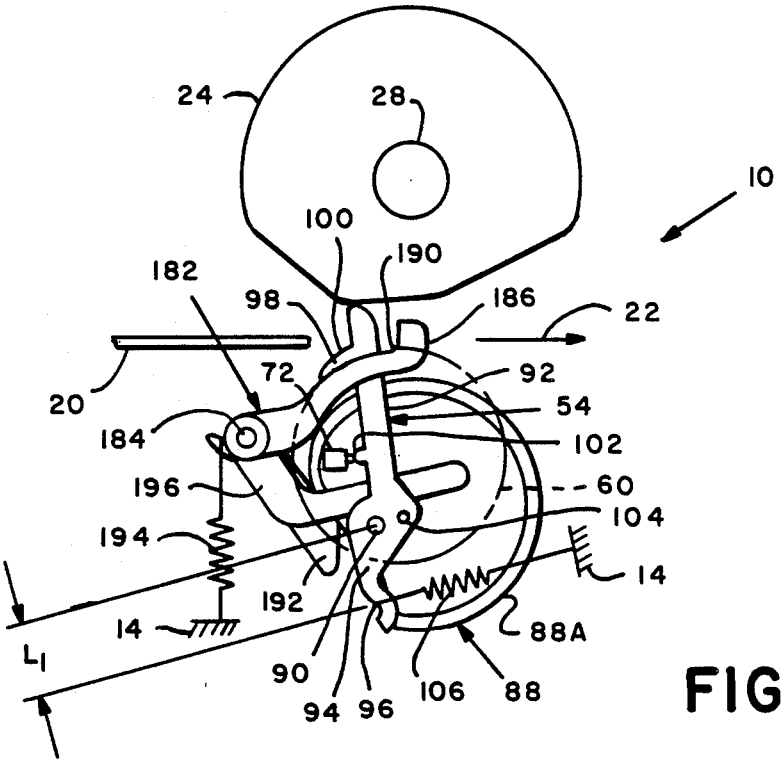
FIG. 3 is a plan view of trip means and registration means of FIG. 2 shown in its normal or at-ready mode of operation.

Prior in time to operation of the mailing machine 10 (FIG. 1), the drive system 70 (FIG. 2) is in its normal or at-ready mode of operation, as shown in FIGS. 1 and 3. As thus shown, the trip lever 54 (FIG. 3) is held, by means of the spring 106, in engagement with trip switch 72, which acts as a travel limiting stop. Moreover, the trip lever shoulder 102 is disposed for holding the trip switch 72 in its operating mode wherein the leads 110 and 110A are electrically connected for maintaining the drive system 70 deenergized. More particularly, the lever arm 40 positions the shutter bar key portion 24 (FIG. 1) in the drum drive gear slot 30, thereby locking the drum drive gear 30 and thus the drum 24 and driving system 70 against rotation. Moreover, when the lever arm 40 is thus held, the drum 24 (FIG. 1) is locked in its home position. And, the motor switch 82 (FIG. 2) is maintained in its mode of operation wherein the leads 120 and 120B are disconnected for preventing the D.C. motor 140 from being energized from the power supply 170, and wherein the leads 120 and 120A are connected for maintaining the shunt circuit across the D.C. motor 140, with the result that the D.C. motor 140 is maintained deenergized.

Figure 4:
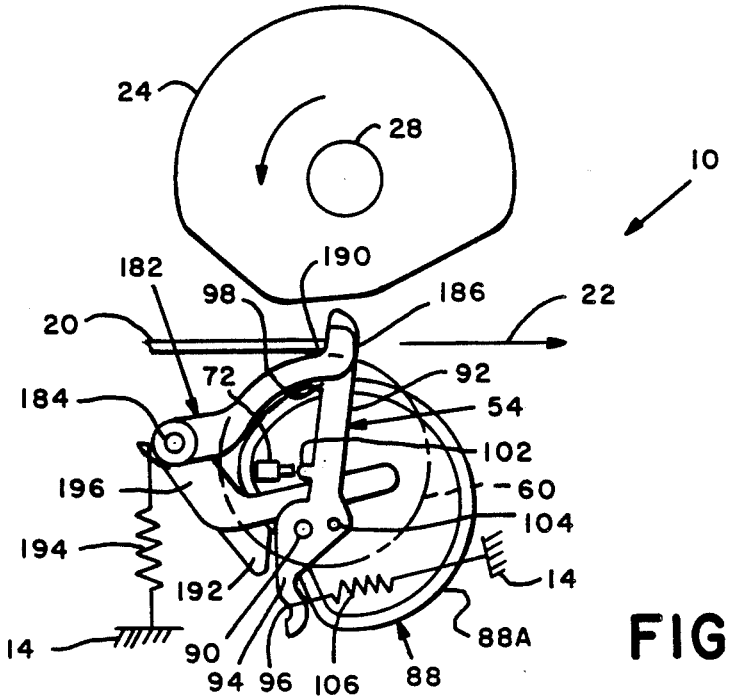
FIG. 4 is a plan view, similar to FIG. 3, showing the trip means and registration means when the trip lever thereof has been moved sufficiently to actuate the trip switch of the driving means.

In operation, when a sheet 20 (FIG. 1) is fed to the base 12, the operator normally urges the sheet edge 52 into engagement with the registration fence 50 and thus into alignment with the direction of the path of travel 22, whereas the sheet 20 is fed towards and into engagement with the trip lever 54. The force exerted by the sheet 20 (FIG. 2) against the trip lever 54 causes the trip lever 54 to rotate about the pivot shaft 90 against the force exerted by the spring 106. If however the operator does not urge the sheet edge 52 into engagement with the registration fence 50, but rather feeds the sheet 20 to the machine such that the sheet edge 52 is at an angle with respect to the registration fence 50, and thus aslant to the direction of the path of travel 22, then, the leading edge of the sheet 20 will engage the stop lever's upper end 186, either before or after engaging the trip lever 92, and tend to be pivoted thereby towards the registration fence 50 until its sheet edge 52 is disposed in engagement with the registration fence 50 for aligning the sheet 20 in the direction of the path of travel 22. As shown in FIGS. 1 and 3, the upper end of the trip lever 92 is preferably located more distantly upstream in the path of travel 22 than the upper end of the stop lever 182, to permit a sheet 20 which is aligned with the registration fence 50 by the operator to commence moving the trip lever 92 before engaging the stop lever's upper end 186. On the other hand, as shown in FIGS. 2 and 4, the trip switch 72 is not operated by the trip lever 54 until the sheet 20 has moved the trip lever's upper leg 92 downstream sufficiently to almost permit the sheet 20 to also be urged into engagement with the stop lever's upper end 186. Preferably, the trip structure 80 and sheet aligning structure 180 are constructed and arranged such that the distance "d" (FIG. 2) that the leading edge of a sheet 20, previously aligned with the registration fence 50, would be offset upstream in the path of travel from the vertically oriented portion of the stop lever's leading edge 190 when the trip switch 72 is actuated for energizing the control mechanism 74, is in the range of from 100 to 150 thousandths of an inch. And, as thus constructed and arranged substantially any sheet 20 fed to the machine 10 with the side edge 52 thereof aslant to the registration fence 50 is pivoted substantially completely into alignment therewith by the stop lever 182, and thus into alignment with the path of travel 22, as the sheet 20 is fed to the machine 10 and before the trip lever has been moved sufficiently by the sheet 20 to actuate the trip switch 72.

As shown in FIG. 4, as the sheet 20 is fed to the machine 10, the trip lever's curvedly-extending upper edge 100 upwardly supports the leading edge of the sheet 20 between and drum 24 and impression roller 60, and, preferably guides the sheet over the impression roller 60, to prevent the leading edges of the lightweight sheets from engaging and being folded against the impression roller 60.

As the trip lever 54 continues to rotate, the trip lever's shoulder 102 operates the trip switch 72, thereby interconnecting the switch leads 110 and 110B for energizing the solenoid 171 from the power supply 170. Whereupon the solenoid 171 causes the control mechanism 82 to move the lever arm 40, for moving the shutter bar key portion 34 (FIG. 1) out of the drum drive gear slot 30 to permit rotation of the drum drive gear 26 and thus the drum 24, and to move the lever arm 40 into engagement with the motor switch 82 to actuate the motor switch 82 for energizing the d.c. motor 140.

When the D.C. motor 140 (FIG. 2) is energized, the motor output shaft 142 drives the gear train 146 and thus the output drive gear 148. And, motor rotation of the drive gear 148 is transmitted by the gear belt 152 to the ejection roller drive gear 154, and to the drive gear 150 and thus the drive system output gear 46, for rotating, in timed relationship with one another, the cam 88, ejection roller shaft 62A and thus the impression roller 60, and the drum drive gear 26 and thus the postage meter drum 24.

Thus the cam 88 (FIG. 2) commences rotation substantially at the same time as the sheet 20 fed to the machine 10 is urged into engagement with the stop lever 182. As the cam 88 rotates, the cam follower 192 follows the cam surface 88A, against the force exerted by the spring 194. However, the cam 88 is preferably dimensioned such that the cam follower 192, and thus the cam shaft 184, are not initially moved by the rotating cam 88, as a result of which the stop lever 182 initially prevents a given sheet 20 from being fed into the path of travel 22 although the impression roller 60 and drum 24 have commenced rotation. Moreover, the cam 88 is dimensioned to commence moving the cam follower 192 and thus the cam shaft 184 after the impression roller 60 and drum 24 have commenced rotation, for rotating the upper end portion 186 of the stop lever 182 in the direction of and downwardly out of the path of travel 20 of a sheet fed into engagement with the stop lever 182 for gating the sheet 20 into the path of travel in timed relationship to rotation of the drum 24. As a result, the drum 24 commences printing indicia on each sheet 20 the same predetermined distance from the leading edge thereof. Accordingly, the sheet aligning structure 180 is constructed and arranged for timely gating sheets 20 fed to the machine 10 into printing engagement with the drum 24, such that the drum 24 initially commences printing indicia on each sheet 20 a predetermined distance from the leading edge thereof.

Figure 5:
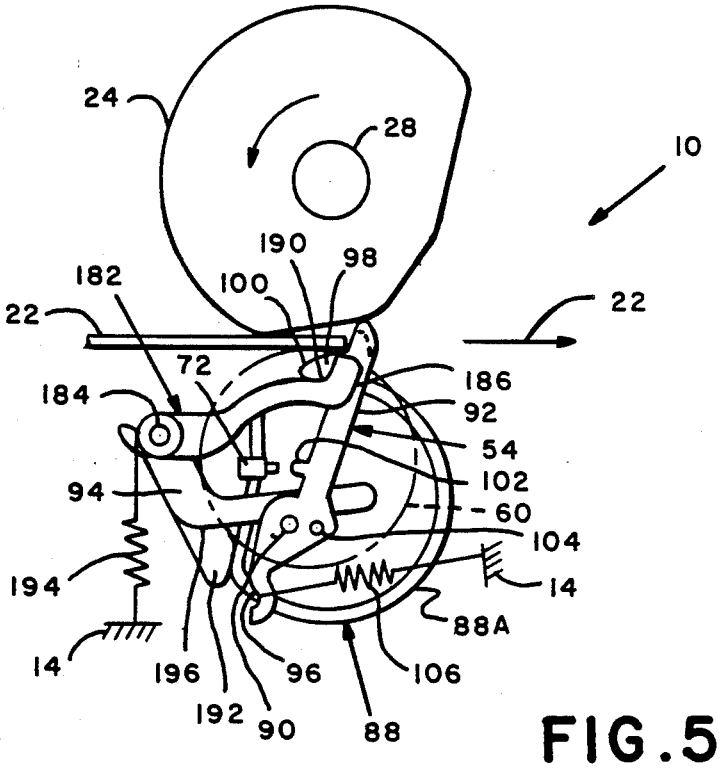
FIG. 5 is a plan view, similar to FIG. 4, showing the trip lever of the trip means and the stop lever of the registration means lowered out of the path of travel of a sheet fed to the machine.
Figure 6:
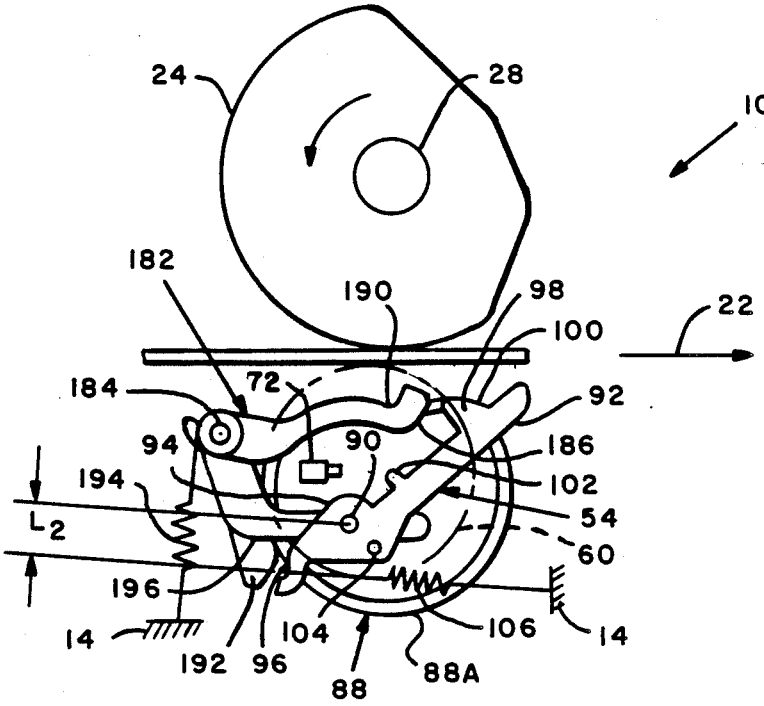
FIG. 6 is a plan view, similar to FIG. 5, showing the extent to which the trip lever and stop lever are lowered beneath the path of travel the sheet feeding means feed as a sheet is fed through the machine.

As shown in FIG. 5, in one embodiment of the invention, the trip lever's upper leg 92 may be dimensioned to exert beyond the path of travel 22 to permit the rotating printing drum 24 to engage and lower the trip lever 54 into the path of travel 22. In which instance, as the drum 24 engages the sheet 20, the sheet 20 will move the upper end of the trip lever 54 out of engagement with the drum 24, against the force of the spring 106, and lower the trip lever 54 beneath the sheet 20 and thus out of the path of travel 22. In addition, in order to reduce the likelihood of the trip lever 54 marking or creasing the underside of the sheet 20 as the sheet is fed between the drum 24 and impression roller 60, the spring 106 is connected to the trip lever 54 as hereinbefore described to ensure that the moment arm due to the spring force acting through the distance "$L_2$" (FIG. 6) is less than the moment arm due to the spring force acting through the distance "$L_1$" (FIG. 3). As thus constructed and arranged, the force exerted by the trip lever 54 on a sheet 20 fed through the machine 10 decreases when the sheet 20 is fed between the drum 24 and impression rollr 60, thereby reducing the likelihood of marking or scoring the underside of a lightweight sheet 20.

Alternatively, and preferably, the trip lever's upper leg 92 (FIG. 5) is dimensioned as shown by the dashed line, to extend into but not beyond the path of travel 22. And, as thus constructed and arranged, the drum 24 does not engage and move the trip lever 54. Rather, the moving sheet 20 lowers the trip lever 54 out of the path of travel 22. Moreover, and preferably, the same follower 104 (FIG. 6) and the cam 196 are appropriately dimensioned such that the rotating cam shaft 184 causes the cam 196 to urge the trip lever's cam follower 104 downwardly and below the moving sheet 20, against the force of the spring 104, as the stop lever 182 is correspondingly lowered, thereby preventing the underside of the moving sheet 20 from being marked or creased by the upper end of the trip lever 54 as the sheet 20 is fed through the machine 10.

As the drum 24 and impression roller 60 rotate in timed relationship with one another and feed the sheet 20 downstream in the path of travel 22 beneath the drum 24, the ejection roller 62 also commences rotating for feeding sheets 22 engaged thereby from beneath the idler roller 66 and thus from the machine 10. Since the angular velocity of the ejection roller rim 62A is normally greater than the angular velocity of the impression roller 60, the peripheral velocity of the ejection roller 62 is greater than that of the impression roller 60, as a result of which the ejection roller 62 tends to pull respective sheets 20 which are fed thereto from beneath drum 24 while the drum 24 and impression roller 60 are still rotating in engagement with the sheets 20. When the drag force exerted on the ejection roller rim 62A, by a sheet 20 engaged by the drum 24 and impression roller 60, exceeds the spring force exerted on the ejection roller rim 62A by the coil spring 62B, the ejection roller shaft 63 continues rotation and stores energy in the coil spring 62B as the ejection roller rim 62A slips relative to the shaft 63, until the drum 24 is no longr in engagement with the sheet 20. Whereupon, the coil spring 62B releases the energy stored therein by driving the ejection roller rim 62A for feeding the sheet 20 from the machine 10. Moreover, as the sheet 20 is fed out of engagement with the trip lever 54, the trip lever 54 is rotated about the pivot shaft 90 by the spring 106, and the stop lever 182 is rotated with the shaft 184 by the spring 194, causing the trip lever 54 and stop lever 182 to be returned to their respective at-ready positions in the path of travel 22. Further, as the trip lever 54 is moved by the spring 106, the trip lever's shoulder 102 operates the trip switch 72 for disconnecting the switch leads 110 and 110B and connecting the switch leads 110 and 110A for returning the trip switch 72 to its at-ready mode of operation.

As or after the ejection roller 62 feeds a sheet 20 from the machine 10, the drive mechanism 74 completes driving the drive system output gear 46, and thus drum drive gear 26 and drum 24, a single revolution. Whereupon, the drive mechanism 74 moves the shutter bar lever arm 40 to actuate the motor switch 82 for deenergizing the motor 140 and to move the shutter bar's key portion 34 (FIG. 1) into the drum drive gear slot 30 to prevent further rotation of the drum drive gear 26 and thus the drum 24. When the switch 82 is actuated, the switch leads 120 and 120B are electrically disconnected for deenergizing the D.C. motor 140, followed by the switch leads 120 and 120A being electrically connected to close the shunt circuit across the D.C. motor 140 for dynamically braking the D.C. motor 140. As a result, the D.C. motor 140 is both deenergized and braked as the shutter bar key portion 24 (FIG. 1) enters the drum drive gear slot 30. When the shutter bar key portion 24 (FIG. 1) locks the drum drive gear 26 and thus the drum 24 in their respective home positions, the control mechanism 74 has returned the drive system 70 (FIG. 2) to its normal or at-ready mode of operation.

In accordance with the objects of the invention there has been described improved sheet aligning structure for use in a mailing machine. Although the invention disclosed herein has been described with reference to a simple embodiment thereof, variations and modifiations may be made therein by persons skilled in the art without departing from the spirit and scope of the invention. Accordingly, it is intended that the following claims cover the disclosed invention and such variations and modifications thereof as fall within the true spirit and scope of the invention.

What is claimed is:

1. In a mailing machine including a postage meter, wherein the postage meter includes rotary means for printing indicia on a sheet fed to the machine, wherein the machine includes means for driving the printing means, wherein the machine includes means for feeding a sheet fed thereto downstream in a path of travel through the machine, wherein the sheet feeding means includes an impression roller rotatably mounted beneath the rotary printing means, and wherein the impression roller has an inner end and an outer end, an improvement comprising:

a. means for aligning a sheet fed to the machine with the path of travel, the aligning means including a registration fence aligned with the path of travel, the aligning means including an elongate stop lever and a shaft on which the lever is pivotally mounted outboard of the outer end of the impression roller, the stop lever extending into the path of travel for pivoting a sheet fed thereto toward the registration fence, the aligning means including a cam rotatable with the printing means, the aligning means including a cam follower secured to the shaft and disposed in engagement with the cam; and b. means for starting operation of the driving means in response to a sheet being fed to the machine, the driving means rotating the cam when the driving means is started, the stop lever located relative to the starting means for pivoting a sheet fed thereto before the driving means is started, and the cam dimensioned for rotating the cam shaft for lowering the stop lever out of the path of travel after the driving means is started.

2. The improvement according to claim 1, wherein the cam is dimensioned for maintaining the cam lowered beneath the path of travel as the sheet is fed through the machine.

3. The improvement according to claim 1, wherein the starting means includes trip means responsive to a sheet fed to the machine for causing the driving means to start rotating the cam and impression roller and printing means.

4. The improvement according to claim 1, wherein the stop lever has an upper end portion extending downstream in the path of travel and has a leading edge extending curvedly downwardly for upwardly supporting a sheet fed to the machine.

5. The improvement according to claim 4 including the leading edge guiding a sheet between the printing means and impression roller as the sheet is fed to the machine.

6. The improvement according to claim 1, wherein the starting means includes trip means, the trip means including a trip lever and a shaft on which the trip lever is pivotally mounted, the trip lever extending into the path of travel, the trip means including a trip switch actuatable for starting operation of the driving means, the trip lever pivoting about the shaft when a sheet fed to the machine moves the trip lever, and the trip lever actuating the trip switch for starting operation of the driving means for rotating the cam shaft when a sheet moves the trip lever.

7. The improvement according to claim 6, wherein the trip lever includes an upper end portion, the upper end portion including a shoulder extending upstream of the path of travel, and the shoulder having an upper edge extending curvedly downwardly for upwardly supporting a sheet fed to the machine.

8. The improvement according to claim 6, wherein the trip means includes means for moving the trip lever out of the path of travel as a sheet is fed beneath the printing means.

9. The improvement according to claim 4, including the trip lever shoulder guiding the sheet between the printing means and impression roller as the sheet is fed to the machine.

10. The improvement according to claim 8, wherein the trip lever moving means includes a cam follower extending from trip lever, and the driving means including means for camming the cam follower and thus the trip lever downwardly as a sheet is fed through the machine.

11. The improvement according to claim 10, wherein the driving means includes a cam shaft rotatable with the printing means, and the camming means includes a cam secured to the cam shaft and disposed in engagement with the cam follower.

12. The improvement according to claim 1, wherein the cam is dimensioned for lowering the stop lever in timed relationship to rotation of the rotary printing means, whereby the stop lever gates a sheet into printing engagement with the drum such that the drum commences printing on the sheet a predetermined distance from the leading edge thereof.

* * * * *